United States Patent [19]

Tomisaka

[11] Patent Number: 4,507,134

[45] Date of Patent: Mar. 26, 1985

[54] AIR FRACTIONATION METHOD

[75] Inventor: Yasushi Tomisaka, Kobe, Japan

[73] Assignee: Kabushiki Kaisha Kobe Seiko Sho, Kobe, Japan

[21] Appl. No.: 500,572

[22] Filed: Jun. 2, 1983

[51] Int. Cl.[3] ..... F25J 3/04

[52] U.S. Cl. ..... 62/30; 62/31; 62/33; 62/34; 62/43

[58] Field of Search ..... 62/22, 23, 24, 25, 26, 62/27, 28, 29, 30, 31, 32–34, 36, 38, 39, 41, 42, 43

[56] References Cited

U.S. PATENT DOCUMENTS 2,666,303 1/1954 Schuftan ..... 62/41

*Primary Examiner*—Frank Sever

*Attorney, Agent, or Firm*—Oblon, Fisher, Spivak, McClelland & Maier

[57] ABSTRACT

A method of fractionation of air which includes the steps of feeding material air compressed by a withdrawing liquefied oxygen from the bottom of a crude argon column, pressurized under its own weight, and gasifying the liquefied oxygen by a reversible heat exchanger to provide an oxygen product while withdrawing an argon-rich gas at the top of the crude argon column by means of a blower so as to maintain the internal pressure of the crude argon column at a reduced pressure.

1 Claim, 2 Drawing Figures

AIR FRACTIONATION METHOD

BACKGROUND OF THE INVENTION

1. Field of the Invention

This invention relates to a method of liquefying and fractionating air and, more particularly, to a method of fractionating air in a total low-pressure system to economically produce oxygen of high purity.

2. Description of the Prior Art

Air liquefaction-fractionation systems involving the liquefaction of air and the fractionation thereof into $N_2$, $O_2$, Ar, etc. are in operation in a broad range of industrial fields. In these air liquefaction-fractionation systems, the material air and the product oxygen must be subjected to compression and decompression procedures under operating conditions and, therefore, the systems must incorporate compressors, expanders and other units. Regarding the power requirement of such machines, the power necessary for compression accounts for a major proportion of the energy used. In fact, the compressor accounts for more than half of the power cost requirement of such an air liquefaction-fractionation plant. Since many air liquefaction-fractionation systems are of large capacity and involve high utility costs, a decrease in power consumption has been in keen demand for the purpose of reducing the overall production cost of oxygen. Such a situation holds true for the so-called total low-pressure air fractionation plant. Nonetheless, substantially no effective measures have been taken in this regard as yet.

The conventional total low-pressure air fractionation system generally operates on the principle depicted in the flow chart of FIG. 1. Thus, the material air supplied through an air filter 1 is pressurized to about 4.6 ata in an air compressor 2. The compressed air is then cooled by an after-cooler 3 and enters a reversible heat exchanger 4 where it undergoes heat exchange with product oxygen and impure nitrogen, whereby it is cooled down to near its boiling point. This air is further fed into first condenser at the bottom of a low-pressure fractionation column 5 (hereinafter referred to briefly as the upper column) and is super-cooled in this condenser 6 to less than its boiling point by heat exchange with the reflux liquid in the upper column 5, whereby it is partially liquefied. Then, in a gas-liquid separator 7, gaseous air and liquefied air are separated from each other and the liquefied air is guided into a total fractionation medium-pressure column 8 (hereinafter referred to briefly as the lower column). The liquefied air in the lower column 8 is gasified to form an ascending gas stream and brought into contact with a reflux liquid (nitrogen-rich liquid) formed by condensation in the top portion of the lower column 8, whereby it is crudely fractionated so that while a nitrogen-rich gas is produced in the top portion of the lower column 8, and said reflux liquid becomes liquefied air containing about 40% of oxygen in the bottom portion of the lower column 8. The gaseous air withdrawn from an intermediate stage of the lower column 8 enters an expansion turbine 9 via conduits 31 and 32, where the required refrigeration is generated. From the turbine 9 the air is passed into the upper column 5 via a conduit 33.

The liquefied air which has undergone crude fractionation in the lower column 8 as mentioned above is fed through a conduit 34 to a liquefied air super-cooler 10 in which it is cooled. The cooled liquefied air is guided via a conduit 35 to a second condenser 12 disposed in the top portion of the crude argon column 11, and in this condenser 12 undergoes that exchange with argon-rich gas in the crude argon column 11, after which it is guided via a conduit 36 to the uppe column 5. On the other hand, the nitrogen-rich liquid collected in the top portion of the lower column 8 flows through a conduit 37 into the liquefied air super-cooler 10 where it is cooled. The cooled air flows via a conduit 38 to the upper zone of the upper column 5. The gaseous air separated by the gas-liquid separator 7 flows through a conduit 27 and a liquefier 13, in which course it is entirely liquefied. The air so liquefied flows via a conduit 29, the liquefied air super-cooler 10 and a conduit 30 to the upper zone of the upper column 5. The oxygen-rich liquid fractionated in the upper column 5 and collected in the bottom zone is withdrawn from the lowermost end of the bottom portion of the upper column 5 and flows via a conduit 51 to a lower portion of the crude argon column 11 for further fractionation. Thereafter, the oxygen-rich gas of high purity in the bottom of the crude argon column 11 is withdrawn via a conduit 45 and fed to the liquefier 13 via a conduit 46. The oxygen-rich gas which has shown some temperature recovery in this liquefier 13 flows through a conduit 47 to the reversible heat exchanger 4 in which a major temperature recovery takes place. The gas is then fed via a conduit 48 to an oxygen compressor 14, where it is pressurized and recovered from the system as product oxygen.

In order to accomplish a smooth recovery of high-purity oxygen by the above-described total low-pressure air fractionation method, it is necessary that (1) the internal pressure of the crude argon column be maintained at a reduced pressure between about 0.8 ata and about 1.0 ata and (2) the pressure of product oxygen at recovery be adjusted to about 1.0 ata to 1.2 ata. For this purpose, the conventional total low-pressure air fractionation system includes an oxygen compressor 14 located in a conduit 48 for withdrawal of product oxygen emerging from the reversible heat exchanger 4 to decompress the crude argon column 11 by suction and to thereby meet the above requirement (1). Moreover, at the stage where a pressure drop to about 0.7 ata takes place at a reversible heat-exchanger 4 after withdrawal at about 0.8 to 1.0 ata from the bottom of the crude argon column 11, the product oxygen is compressed to about 1.2 ata so as to satisfy the above requirement (2). Since a large-scale oxygen compressor is used to effect such a comparatively small decrease and increase of pressure, the high power cost cannot be reduced effectively and acts as a rate-determining factor in the improvement of the overall economics of the air fractionation plant. Therefore, in total low-pressure air fractionation systems, it has been considered necessary to develop technology which would be capable of meeting the above-mentioned two operation requirements (1) and (2) under a minimum power cost for meeting these requirements.

SUMMARY OF THE INVENTION

Having accomplished the above-mentioned requirements, the present invention has as its object the reduction in cost of power consumed by the conventional oxygen compressor and to thereby enhance the overall economics of the total low-pressure air fractionation plant while meeting the above-mentioned operation requirements (1) and (2). In accordance with this invention, the above object is accomplished by an organic combination of separate novel technical means with the air fractionation setup without employing the above-mentioned oxygen compressor.

The air fractionation method of the present invention which has thus accomplished the above object is such that the argon-rich gas in the top portion of the crude argon column is extracted with a blower to meet the above operation requirement (1) and that liquid oxygen is withdrawn from the crude argon column at a level below the liquid level thereof and pressurized under its own gravity to meet the above operation condition (2).

BRIEF DESCRIPTION OF THE DRAWINGS various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 1 is a flow diagram showing a conventional total low-pressure air fractionation method; and FIG. 2 is a flow diagram showing the total low-pressure air fractionation method according to this invention.

DETAILED DESCRIPTION OF THE PREFERRED EMBODIMENTS

Figure 2:
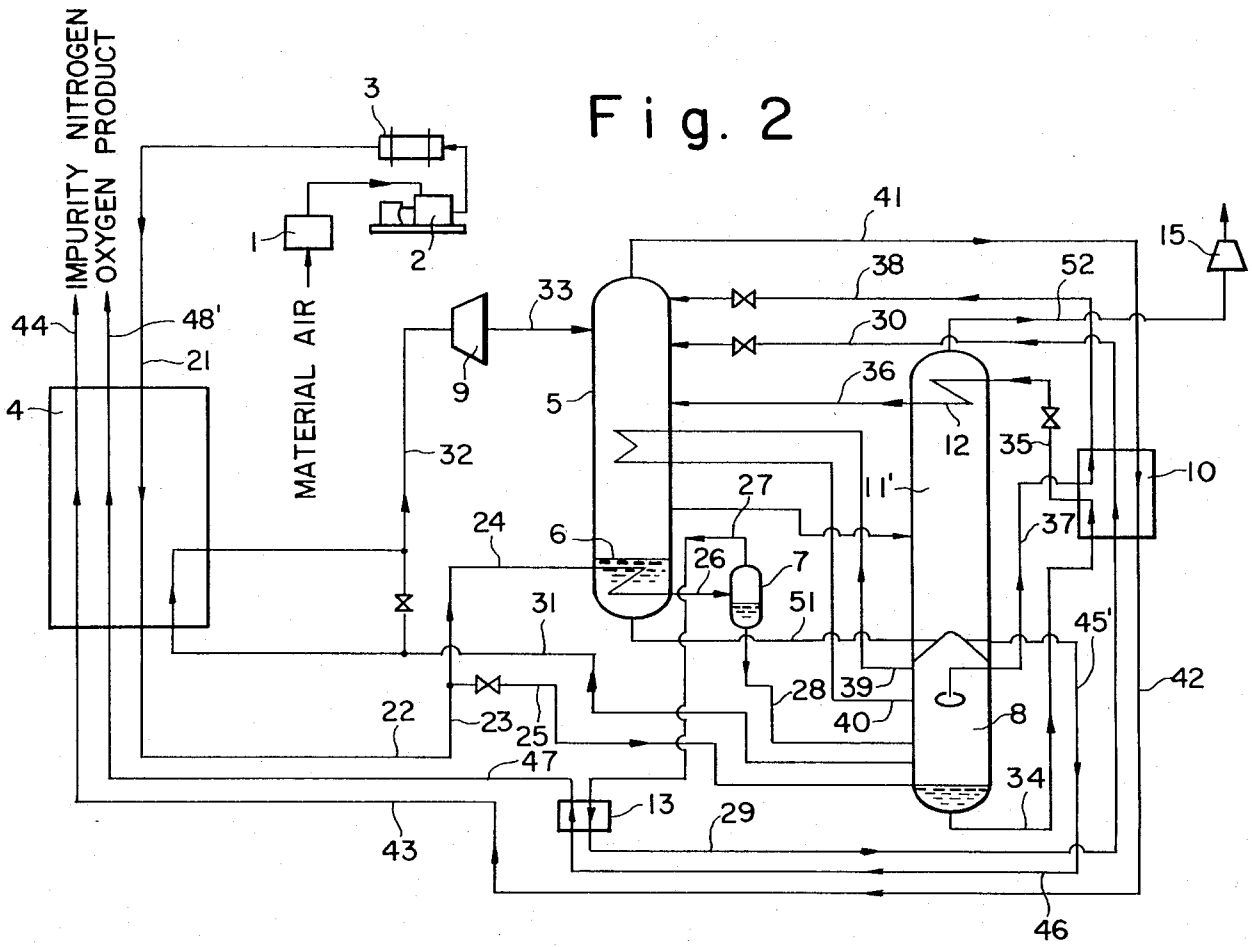

The construction and operation of the present invention will be explained hereinafter, reference being had to the accompanying FIG. 2 illustrating an embodiment of the invention. It should, however, be understood that the embodiment described below is merely illustrative of this invention and that appropriate changes and modifications may be made without departing from the spirit of this invention which is mentioned hereinbefore and hereinafter.

Figure 1:
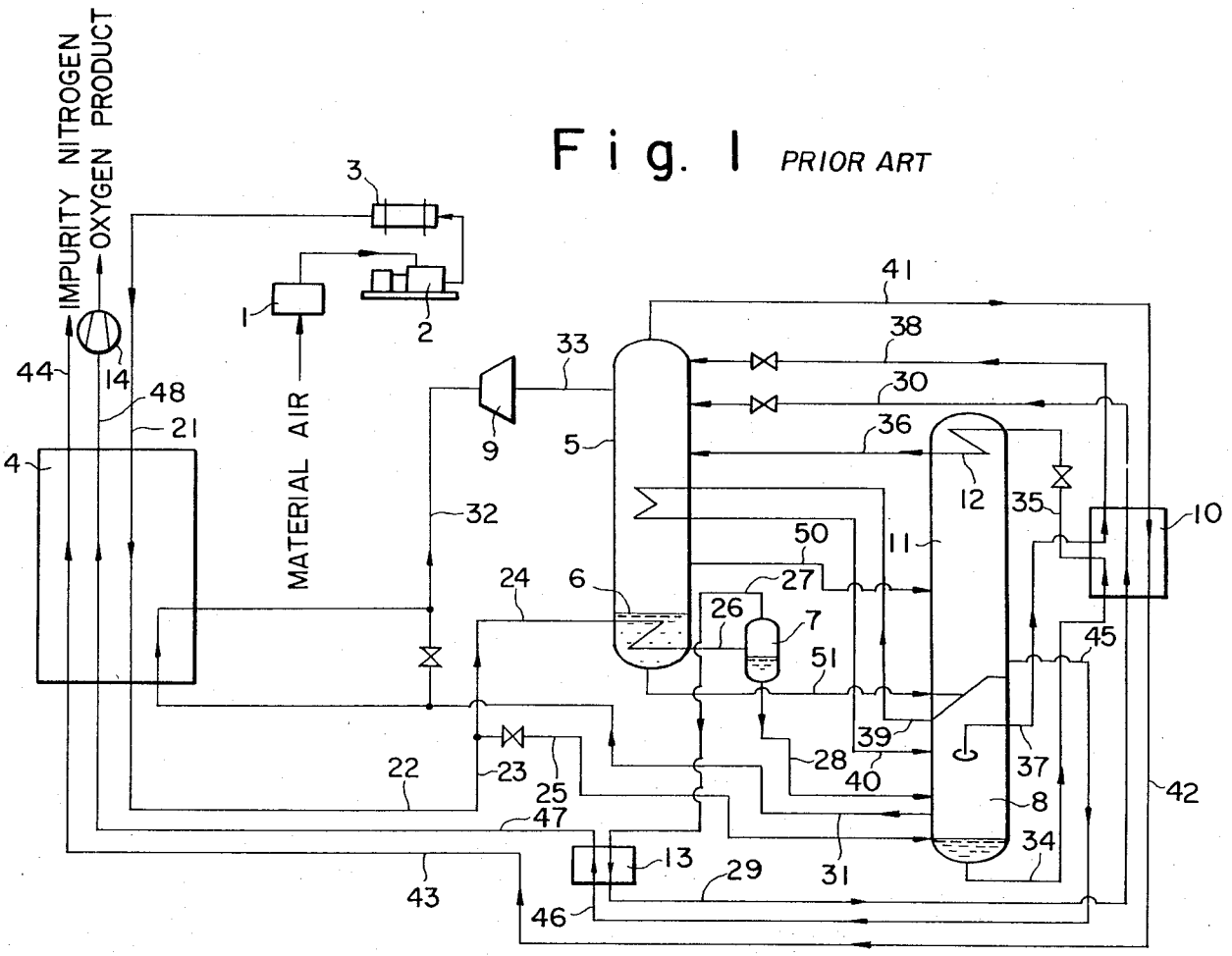
Fig. 1 PRIOR ART

FIG. 2 is a flow chart showing the total low-pressure air fractionation system according to the present invention. It is identical with that shown in FIG. 1 as far as the basic construction is concerned and, therefore, like elements are designated by like reference numerals. The feature which is most remarkably different from the prior art construction and which characterizes the present embodiment most saliently lies in the construction of the top and bottom portions of a crude argon column 11', and of a conduit 48'. In the following detailed description, emphasis will be placed on these aspects and the elements identical with the conventional ones will not be explained. Thus, the argon-rich gas collected in the top portion of the crude argon column 11' is taken out from the blower 15 via a conduit 52. In this connection, the blower 15 is operated in such a manner that the internal pressure of the crude argon column will be maintained at about 0.8 to 1.0 ata. On the other hand, an oxygen-rich liquid of high purity collected in the bottom of said crude argon column 11' is withdrawn via a descending conduit 45' at a level below the liquid level thereof. Since the bottom of the crude argon column 11' is situated at an elevation relatively higher than the conduit 46, the oxygen-rich liquid withdrawn at about 0.8 to 1.0 ata from the bottom is automatically pressurized to about 1.2 ata under its own gravity as it flows down the descending conduit 45'. As a result, even though the liquid undergoes some pressure loss as it passes through the conduit 46, liquefier 13, conduit 47 and reversible heat exchanger 4, the pressure of oxygen recovered from the system via the conduit 48' is maintained and controlled at about 1.0 ata.

Thus, in this embodiment, the internal pressure of the crude argon column is controlled with the blower 15 for withdrawal of argon rich gas and the compression of product oxygen for recovery is effected by its own gravity. In comparison with the conventional system illustrated in FIG. 1, the oxygen compressor 14 is omitted and, instead, a blower 15 for withdrawal of argon-rich gas is added. However, since the amount of gas treated by this blower 15 (flow rate of argon-rich gas) is only about 1/20 of the amount of gas treated by the oxygen compressor (flow rate of product oxygen), its scale may be relatively small and, while it is true that an additional power cost is entailed by the new provision of the blower 15 for withdrawal of argon-rich gas, the omission of the large-capacity oxygen compressor 14 results in remarkable savings in power cost so that the overall power cost of the total low-pressure air fractionation system is drastically reduced.

Because of the above construction, the air fractionation method of the present invention permits the economic production of oxygen product of high purity. Moreover, since the invention does conserve energy by reducing the power requirement of the air fractionation plant, it contributes a great deal to the industry in this age of energy conservation.

What is claimed as new and desired to be secured by Letters Patent of the United States is:

1. A method for fractionation of air utilizing a compressor, a first condenser, a low pressure column having an upper portion, a medium-pressure column, a second condenser located at the top of a crude argon column, a reversible heat exchanger and a blower, which comprises:

feeding material air compressed by said compressor and cooled by said heat exchanger to said first condenser;

subjecting the material air to heat exchange with liquefied oxygen in said low pressure column to evaporate said liquefied oxygen and form an ascending gas in said low-pressure column and, simultaneously, super-cooling the material air to a temperature below the boiling point thereof so as to cause partial liquefaction thereof;

contacting said ascending gas with a reflux liquid from said upper portion of said low-pressure column to effect fractionation thereof and thereby convert a reflux liquid collected in a bottom portion of said low-pressure column to an oxygen-rich liquid;

introducing said liquefied air into said medium-pressure column and gasifying said liquefied air therein to produce an ascending gas in said medium-pressure column and contacting it with a reflux liquid produced by condensation at a top portion of said medium-pressure column so as to cause fractionation thereof and provide a nitrogen-rich gas at the top of the medium-pressure column while transforming said reflux liquid into liquefied air at the bottom of the medium-pressure;

cooling said liquefied air and passing it into said second condenser located at the top of said crude argon column;

subjecting said liquefied air to heat exchange with an argon-rich gas in the crude argon column so as to gasify the liquefied air prior to feeding the liquefied air into the low-pressure column, and which further comprises withdrawing liquefied oxygen from the bottom of said crude argon column, pressurized under its own weight, and gasifying the liquefied oxygen by said reversible heat exchanger to provide an oxygen product while withdrawing an argon-rich gas at the top of said crude argon column by means of said blower so as to maintain the internal pressure of the crude argon column at a reduced pressure; and maintaining the internal pressure of said crude argon column at about 0.8 to about 1.0 ata and the liquefied oxygen at about 1.0 ata to about 1.2 ata, solely by said blower and a static head of liquid oxygen of predetermined height.

* * * * *